United States Patent [19]

Lewis

[11] Patent Number: 4,459,923

[45] Date of Patent: Jul. 17, 1984

[54] METHOD AND APPARATUS FOR EFFICIENTLY CONTROLLING THE INCINERATION OF COMBUSTIBLE MATERIALS IN A MULTIPLE HEARTH FURNACE SYSTEM

[75] Inventor: Frederick M. Lewis, Mountain View, Calif.

[73] Assignee: Sterling Drug, Inc., New York, N.Y.

[21] Appl. No.: 467,606

[22] Filed: Feb. 18, 1983

[51] Int. Cl.[3] ..... F23G 5/04

[52] U.S. Cl. ..... 110/346; 110/185; 110/190; 110/225; 110/347

[58] Field of Search ..... 110/225, 185, 186, 188, 110/190, 341, 346, 347, 348

[56] References Cited

U.S. PATENT DOCUMENTS 4,013,023 3/1977 Lombana et al. ..... 110/225 X 4,391,208 7/1983 Lewis ..... 110/225 X

*Primary Examiner*—Edward G. Favors

*Attorney, Agent, or Firm*—Wenderoth, Lind & Ponack

[57] ABSTRACT

The present invention relates to a method and apparatus for controlling the operation of a multiple hearth furnace system for efficiently incinerating combustible materials, such as sludge in which the air of combustion is essentially all introduced at the bottom of the furnace to incinerate solid materials. This control involves the following essential steps:

scanning the temperature of two or more combustion hearths to determine which is the hottest hearth;

controlling the temperature of the thus-determined hottest hearth at a predetermined temperature set point value;

controlling the oxygen content of the system exhaust gas at least as high as the predetermined set point value; and maintaining the system exhaust temperature at least as high as the predetermined set point value.

28 Claims, 3 Drawing Figures

METHOD AND APPARATUS FOR EFFICIENTLY CONTROLLING THE INCINERATION OF COMBUSTIBLE MATERIALS IN A MULTIPLE HEARTH FURNACE SYSTEM

BACKGROUND OF THE INVENTION

1. The Field of the Invention

The present invention relates to an improved method and apparatus for controlling the incineration of combustible materials, particularly combustible waste materials, such as sewage sludge, in a multiple hearth furnace system in which the combustion air used to incinerate the solid combustible materials is substantially all introduced at the bottom portion of the multiple hearth furnace forming part of said system.

2. The Description of the Prior Art

It is well known to incinerate combustible materials, especially waste materials, such as sewage sludge, in multiple hearth furnaces. In the early use of such furnaces for incinerating waste materials, e.g., sludge, the sludge was simply fed to the uppermost hearth, and air was supplied to the lowermost hearth, with fuel burners placed on the various hearths as needed for ensuring that combustion took place. In such a multiple hearth arrangement, the furnace operated to dry the sludge in the uppermost hearths and the thus-dried sludge was passed from hearth to hearth until it was substantially completely incinerated and the ash discharged from the lowermost hearth.

In a typical multiple hearth furnace for treating sludge, the furnace is generally divided into four distinct operating zones, viz. (1) an upper drying zone defined by one or more drying hearths in which a major portion of the free water contained in the sludge is evaporated; (2) an intermediate combustion zone defined by at least one hearth in which the volatile combustible materials contained in the sludge are combusted; (3) a lower fixed carbon combustion zone; and (4) a final cooling zone defined by one or more bottom hearths in which the inert solid residue remaining from the combustion process in the combustion zone is cooled by air and the ash ultimately discharged from the bottom of the furnace. In such a multiple hearth furnace, the solid sludge is introduced into the top of the furnace and is descended from one zone into another until it reaches the lowest zone where it is finally discharged from the lowest hearth known as the "ash cooling" hearth.

According to the first attempts to effect this sludge combustion, air was introduced at the bottom of the furnace to react with the combustible waste material on the various hearths so as to incinerate the sludge and both the unreacted air and gaseous products of combustion from the combustion zones flow upwards countercurrent to the downward flow of the solid materials. The gases were then usually treated by various means to remove the malodorous gases and pollutants by such means as an afterburner either located above the first sludge handling hearth or located separately from the main furnace and/or by use of a scrubber.In connection with this air introduced at the bottom of the multiple furnace, Applicant is referring to the air which passes over the solid material such as sludge as opposed to air as introduced into the afterburner in the case e.g., when the furnace is operated in the pyrolysis mode.

In respect to these earlier furnaces in which air is introduced primarily through the lowermost hearth or hearths, it is extremely difficult to control the temperatures of the individual combustion hearths within carefully controlled limits so as to ensure satisfactory combustion and at the same time prevent runaway temperatures. In such instance, the previous practice has been to choose a fixed main combustion hearth in which the principal combustion takes place and to control the temperature of this hearth within certain preselected parameters to ensure adequate combustion, while at the same time preventing runaway temperatures which might result in deleterious thermal stress in the furnace parts. However, the feed of sludge to a furnace is difficult to control, and in practice there is a constant but random variation in feed rate and/or sludge characteristics that make it difficult to operate such a furnace at optimum conditions. Since the combustion control logic in the prior art furnace is based on a particular hearth being the main combustion hearth, the feed rate of the sludge to the furnace or rotational speed of the rabble arms must be varied in an attempt to maintain this condition. Adjusting either the feed rate of sludge or the rotational speed of the rabble arms has a large impact on the entire sludge incineration system, including the air emission cleanup devices, such that these changes are not easily made. Therefore to minimize operating difficulties with this system, the operator will frequently run the system at reduced sludge feed rates or high rates of excess air, thereby resulting in the furnace system being under-utilized.

Moreover, these existing multiple hearths systems in which the sludge combustion air is introduced through the bottom of the furnace are largely inefficient, since not all of the germane parameters involved in incineration are addressed. For example, it is not infrequent that operators are additionally directed to maintain a specified furnace exhaust temperature, furnace exhaust oxygen content and the temperature of a specified combustion hearth during the operation of the furnace, but some of these directions must ordinarily be disregarded. This is because operators of such furnaces simply cannot control all three of these parameters with a single manipulated variable, e.g., the air flow at the bottom of the furnace, and therefore find it necessary to disregard exhaust temperature and oxygen control points to prevent damage to the internal portion of the furnace due to excessive hearth temperatures. In addition, excessive hearth temperatures can cause operating problems such as clinker formation and thus the control of operation of these earlier furnaces have been fraught with problems.

Recently, there have been attempts to improve the efficiency of combustion and the design of the multiple hearth furnaces, while at the same time preventing runaway temperatures. For example, in U.S. Pat. No. Re 31,046 and 4,182,246, the temperatures in several of the lower hearths have been monitored and the supply of air and fuel to these hearths controlled so as to pyrolyze the materials. According to this general method, the pyrolyzing furnace is caused to operate with a deficiency of air over its operating range, while the afterburner is caused to operate with excess air so as to complete combustion of the combustible materials in the exhaust gas and also to control the operating temperatures by quenching the gases in the afterburner when necessary.

In U.S. Pat. Nos. 4,046,085 and 4,050,389, a multiple hearth furnace is also operated by separately supplying air and fuel to the respective hearths in response to the temperatures on the individual hearths to control the temperature thereof.

According to these more recent developments in the art of multiple hearth furnaces, the supply of air and fuel to the individual hearths and the use of more sophisticated monitoring devices have made it possible to more efficiently control the combustion parameters and temperatures of the individual hearths so as to create optimum conditions for ensuring that a relatively high level of combustion efficiency takes place, while at the same time making it possible to prevent or make unlikely the possibility of runaway temperatures.

While the more recent methods described above represent an improvement over the first multiple hearth furnaces in which air was introduced solely into the bottom of the furnace, nevertheless, the more recent furnaces in which air and fuel is carefully controlled on each of the individual hearths are expensive, especially when considering the sophisticated monitoring and control systems involved in these processes, most of these more recent apparatus designs being automated or computerized.

OBJECTS OF THE INVENTION

An object of the present invention is to improve the operating efficiency of the older and/or simplier designed multiple hearth furnaces with or without an afterburner in which substantially all of the air used to combust the solid material is introduced at the bottom portion of the furnace.

It is another object of the present invention to provide a method and apparatus for control of the operation of such multiple hearth furnaces which involves monitoring the multiple hearth furnace to determine the hottest hearth and controlling the temperature thereof at a predetermined temperature set point value.

It is another object of the present invention to provide a method and apparatus for control of the operation of such multiple hearth furnaces which involves controlling the exhaust oxygen content at or above a predetermined set point and controlling the exhaust temperature of the furnace at or above a predetermined temperature set point value.

Finally, it is still another object of the present invention to provide a method and apparatus for controlling the operation of such a multiple hearth furnace in either the excess air mode and the starved air (or pyrolysis) combustion mode so as to ensure efficient operation.

BRIEF DESCRIPTION OF THE FIGURES

The invention will now be described in greater detail in connection with the accompanying drawings, in which.

DETAILED DESCRIPTION OF THE INVENTION

Figure 1:
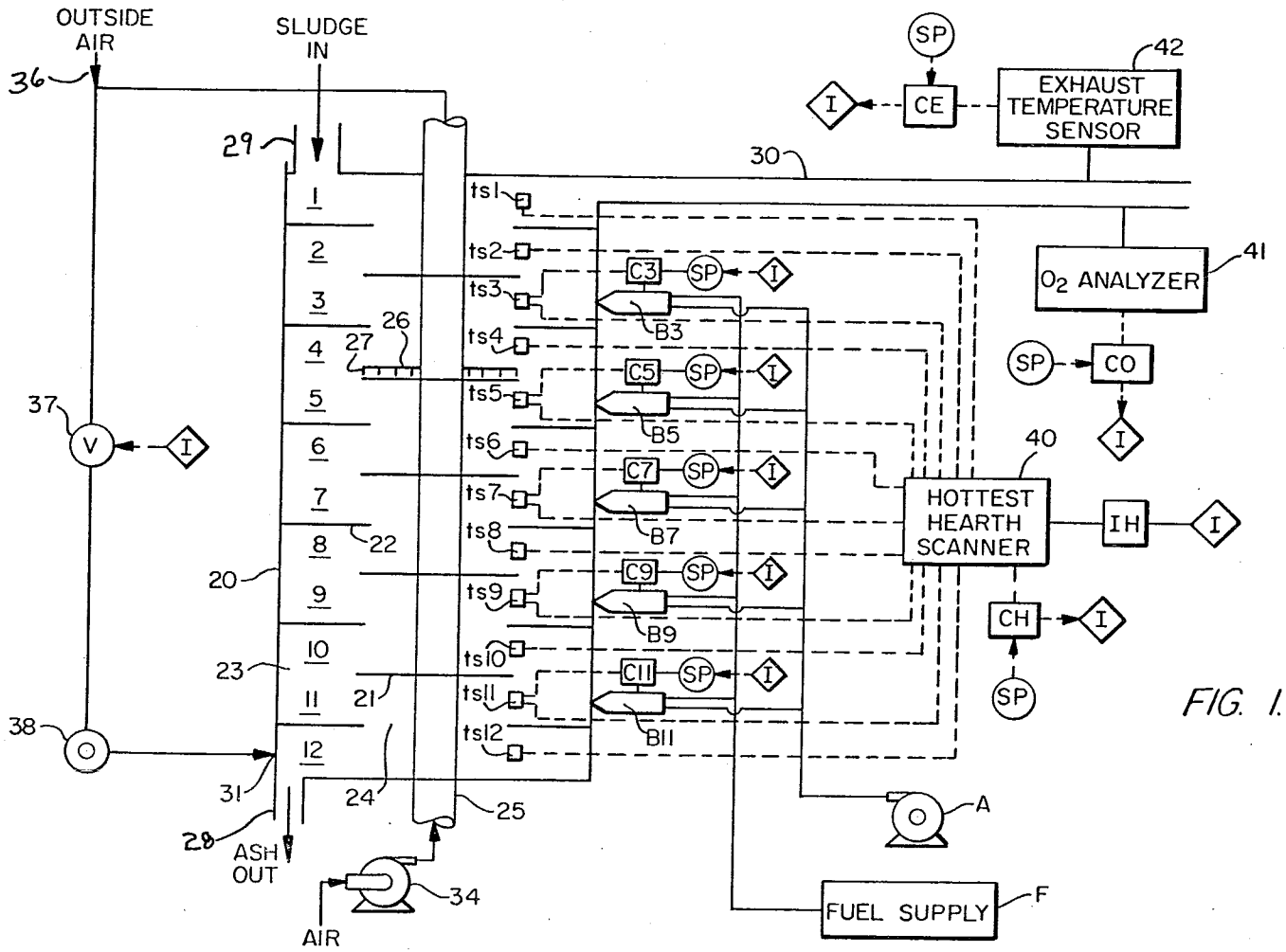
FIG. 1 is a schematic view of a multi-hearth furnace with a control system according to the invention for carrying out the method of the invention.

In the following, the term "multiple hearth furnace system" is used to mean a system having a multiple hearth furnace with or without an afterburner.

As indicated above, the usual procedure in operating a multiple hearth furnace system is to choose a single hearth for the essential combustion zone and to maintain it within certain limits. The present invention departs from this conventional procedure by using a scanner or a monitor to determine the temperature of the hottest hearth. The temperature of the hottest hearth is then essentially maintained at a predetermined temperature set point value by regulating the combustion air flow introduced at the lower hearth(s). In a typical furnace, as contemplated by the present invention, air may be introduced at any or all of the hearths below the hottest hearth. In the usual situation, the air is introduced into the bottom three hearths. Therefore, throughout the specification and claims, it will be understood that the term "bottom" means any hearth or hearths below the hottest hearth; preferably the lowermost hearths.

In another aspect of the present invention, the content of oxygen in the exhaust gases from the furnace system is maintained at or above a predetermined set point value. This oxygen content represents the volume percent of oxygen leaving the multiple hearth furnace system and is measured by an oxygen analyzer ordinarily provided within an exhaust line connected to the exit of the furnace system. In another feature of the present invention, the exhaust gas temperature, i.e., the exhaust gases leaving the furnace system, are maintained at or above a predetermined set point value. The location where the exhaust gas temperature is measured varies, depending upon whether the incineration is conducted in the excess air mode or the pyrolysis mode.

In respect to the above points, it will be noted that the hottest hearth is always controlled at a predetermined set point value, whereas the oxygen content in the exhaust gases and the exhaust gas temperature can, on occasion, be permitted to rise above their predetermined set point values. This is because it is occasionally difficult or indeed impossible to maintain the oxygen content and temperature of the exhaust gases at a predetermined set point value, while maintaining the hottest hearth temperature at its set point, especially in the case of burning very dry sludge. However, neither the oxygen content, nor the exhaust gas temperature are permitted to fall below predetermined set point values, except for the minor fluctuations which occur which indicate that it is necessary to correct furnace system conditions so that the oxygen content and exhaust gas temperature return to the predetermined set point values.

According to Applicant's procedure as outlined above, it is possible to greatly improve upon the efficiency of older and/or less efficient multiple hearth furnaces in which air is directed to the bottom portion of the furnace as opposed to being regulated on each individual hearth by the more sophisticated means used by the prior art discussed above.

Before describing the principle of operation behind Applicant's improved method and apparatus, it must be pointed out that there are two modes of operation of a multiple hearth furnace, viz., an excess air mode and a starved air (or pyrolysis) mode of operation.

In respect to the system oxygen content as used in the present application (for all modes of operation) this represents the amount of oxygen in excess of the amount necessary for stoichiometric combustion. This can be determined by sensing the percent oxygen in the exhaust gases which can then be related to the excess air by the following:

$$PSA = 1 + \frac{\% O_2}{21 - \% O_2} \times 100$$

Where PSA = Percent Stoichiometric Air $\%O_2$ = Percent Oxygen in the System Exhaust Gases Percent stoichiometric air can be converted mathematically to percent excess air as follows:

$$PXSA = PSA - 100$$

Where: PXSA = Percent Excess Air

Hereinafter, reference will be made percent stoichiometric air and oxygen content, it being understood that they express the same concept.

In the excess air mode the amount of air generally required in the exhaust gases is approximately 175% stoichiometric under ordinary circumstances. It is necessary to have this excess air in order to ensure combustion of materials such as organic waste materials by ensuring complete oxidation of the organic substances or combustible materials in the waste.

According to the starved air mode of operation, the multiple hearth furnace is operated under oxygen starved conditions (substoichiometric) which is regulated to only partially complete the oxidation of the organic substances pyrolyzed from the waste in the case of burning waste materials, such as sludge. In this mode of operation, the multiple hearth furnace system contains an afterburner in which air, and heat if necessary, are introduced to complete the oxidation of the partially oxidized substances carried by the gases and the vapors from the furnace. More specifically, in the pyrolysis mode, the furnace is caused to operate with a deficiency of air over its operating range, while the afterburner is caused to operate with excess air as measured downstream of the afterburner and is typically about 140% stoichiometric air to ensure incineration of the combustion materials in the waste gases.

The present invention contemplates a novel control method for both the excess air mode and the pyrolysis mode of operation.

Although the present invention is concerned in a broad sense with incinerating combustible materials and the control of that incineration, the method and furnace disclosed herein are primarily concerned with incinerating combustible waste materials, such as sludge and the control of such incineration. Accordingly, the discussion of the details of the instant invention will be directed primarily to the incineration of sludge, it being understood that the fundamental principles of operation disclosed can be applied to incinerate any combustible materials.

In respect to the sludge material, the process and apparatus of the present invention relates to incineration of both autogenous and non-autogenous sludge and the control of such incineration. These materials are well known in the art, non-autogenous sludge being sewage sludge which usually contains a large amount of water and/or having a lower calorific value than autogenous sludge and generally requiring a great deal of fuel to incinerate such sludge. On the other hand, autogenous sludge, a typical form of which is sludge treated by a thermal conditioning process which makes it possible to remove a large amount of water from the sludge in a dewatering operation such as by use of a vacuum filter and/or where the combustible solids have a high heating value, can be incinerated with minimum or no auxiliary fuel.

Before discussing the details of the invention, a typical multiple hearth furnace system with which the invention is used will be described so that the novel control method will be understood in respect to the operation of said multiple hearth furnace system.

As seen in FIG. 1, the multiple hearth furnace 19 is basically the same as the prior art multiple hearth furnaces, such as shown in U.S. Pat. No. 4,050,389 to von Dreusche, Jr. It has a tubular outer shell 20 which is a steel shell lined with fire brick or other similar heat resistance material. The interior of the furnace is divided by means of hearth floors 21 and 22 into plurality of vertically aligned hearths, the number of hearths being preselected depending upon the particular waste material being incinerated, and here shown as top hearth 1 and hearths 2–12. Each of the hearth floors is made of a refractory material and is preferably slightly arched so as to be self supporting within the furnace. Outer peripheral drop holes 23 are provided near the outer shell at the outer periphery of the floors 21 and central drop holes 24 are provided near the center of the hearth floors 22. A hollow rotatable vertical center shaft 25 extends axially through the furnace and is supported in appropriate bearing means at the top and bottom of the furnace. This center drive shaft 25 is rotatably driven by an electric motor and gear drive (not shown). A plurality of spaced rabble arms 26 are mounted on the center shaft 25, and extend outwardly in each hearth over the hearth floor. To keep the drawing simple, the rabble arms have been shown only in hearth 4. The rabble arms have rabble teeth 27 formed thereon which extend downwardly nearly to the hearth floor. As the rabble arms 26 are carried around by the rotation of the center shaft 25, the rabble teeth 27 continuously rake through the material being processed on the respective hearth floors, and gradually urge the material toward the respective drop holes 23 and 24.

The lowermost hearth 12 is a hearth for collecting the ash, and cooling it, and is called an ash cooling hearth.

An ash discharge 28 is provided in the bottom of the ash cooling hearth through which the ash remaining after combustion of the waste material is discharged from the furnace.

The multiple hearth furnace has a waste feed inlet 29 for supplying waste material to a waste material receiving hearth, which in FIG. 1 is the uppermost hearth 1. The furnace can be modified to feed the waste material to a hearth other than the uppermost hearth.

An exhaust gas outlet 30 is provided from the top hearth 1, and substantially all of the combustion air for the waste material is supplied through an air inlet in the bottom hearth or hearths. Here air inlet 31 is in the bottom hearth. The material is passed downwardly through the furnace in a generally serpentine fashion, i.e., alternately inwardly and outwardly across the hearths, while the combustion gases from the various hearths flow upward countercurrent to the downward flow of solid material. The gases flow upward in a serpentine or convoluted flow pattern through the openings 23 and 24 across the sludge or slurry on the hearths.

The furnace is provided with a fan 34, the discharge side of which is directed through the hollow shaft 25 for supplying air for cooling the shaft. In the present embodiment, the air is shown as being pumped upwardly through the shaft where it is preheated, and the preheated air is directed through conduit means, schematically represented at 35, to an outside air inlet conduit 36, at which the preheated air is mixed with outside air drawn through a control valve 37 by a fan 38 and directed into the air inlet 31 in the bottom hearth 12. The use of fan 38 is optional. Another alternative way of controlling the air supply means to the furnace would be to provide opposed acting valves, e.g., one located on an air discharge line connected to the top of the hollow shaft 25 and the other valve located on the recycle line connected to said air discharge line, which recycles the hot air from the hollow shaft 25 to the air supply line 31. This permits air used to cool the hollow shaft 25 to be simply exhausted at the top of the furnace or recycled back to the air supply line 30 for introduction to the bottom of the furnace. Other means of supplying air to the bottom of the furnace can be provided, such as the use of auxiliary fans, etc. Thus, the variations of the air supply loops which are introduced into the bottom of the furnace for combustion purposes or to cool the hollow shaft 25 may be greatly varied.

Further, certain of the hearths, for example in the present embodiment hearths 3, 5, 7, 9 and 11 are provided with a burner means B, which can be one or more burners. The burners are supplied with fuel and air from a fuel supply F and an air supply A.

The furnace as thus described is provided with control means for controlling the operation thereof. The control means has a temperature sensor $t_s$ in each of the hearths, which can be a thermocouple or the like. Each of the burner means is controlled by a conventional temperature controller C which can be set to a desired temperature set point by a set point controller SP and which is connected to the corresponding temperature sensor $t_s$ for the respective hearth. The set point controllers are each controlled through an interlock I to change the setting thereof. This enables control of the firing rate of the burner means.

A hottest hearth scanner 40 is connected to each of the temperature sensors $t_s$, and functions to scan the temperatures of each of the waste material handling hearths and determine which of these hearths is the hottest hearth and what the temperature of that hearth is. This is a conventional apparatus available commercially and further details of the structure and operation will not be given. Connected to the hottest hearth scanner 40 is a hottest hearth temperature controller CH which can be set to a desired hottest hearth temperature by a set point controller SP therefor, and which functions to compare the temperature of the hottest hearth as indicated by the scanner 40 with the set point value and produce an output to the interlock I therefor as to whether the temperature of the hottest hearth is at the set point temperature, above it or below it. Also connected to the hottest hearth scanner is a hottest hearth indicator IH which indicates which of the hearths is the hottest hearth and supplies this to the interlock I therefor. Again, these devices are conventional and commercially available and will not be described further.

Connected in the system exhaust gas outlet 30 is an oxygen analyzer 41 which analyzes the exhaust gas flowing therethrough and provides an output indicating the oxygen content of the exhaust gas. To the output thereof is connected an oxygen content controller CO which, in the same manner as the hottest hearth temperature controller, can be set to a desired system exhaust gas oxygen content by a set point controller SP therefor, and which functions to compare the oxygen content sensed by the analyzer with the set point value and produce an output to the interlock I therefor as to whether the oxygen content is at the set point value or above or below the value.

Also connected in the system exhaust gas outlet 30 is an exhaust gas temperature sensor 42, such as a thermocouple, which senses the temperature of the system exhaust gas flowing therethrough and provides an output indicating the temperature. This temperature sensor 42 may be replaced by temperature sensor $t_s$1 in those situations where the temperature sensed at these two locations would be substantially the same. To the output thereof is connected an exhaust gas temperature controller CE which can be set to a desired system exhaust gas temperature by a set point controller SP therefor and which functions to compare the sensed temperature with the set point value and produce an output to the interlock I therefor as to whether the temperature is at the set point value or above or below the value.

The valve 37 is also connected to an interlock for being controlled so as to be variably modulated between opened or closed as required.

The interlocks I are for connecting the various instruments and the valve 37 and the burner set point controllers SP. The interlocks are to some logic system for operating the valve 37 and the burner controllers SP in response to the outputs of the instruments in order to carry out the control methods to be described. The system can be a manual system, i.e. human beings who observe the outputs of the controller CH, CO and CE and manipulate the burner set point controllers and the valve 37 manually, or can be a semi-automatic system in which some of the operations of the valve and burner controllers are automatic and some are manual, or a fully automatic system, in which a computer is connected to the various interlocks I so as to sense the outputs of the controllers CH, CO and CE and automatically operate the burner controllers and the valve 37.

Figure 2:
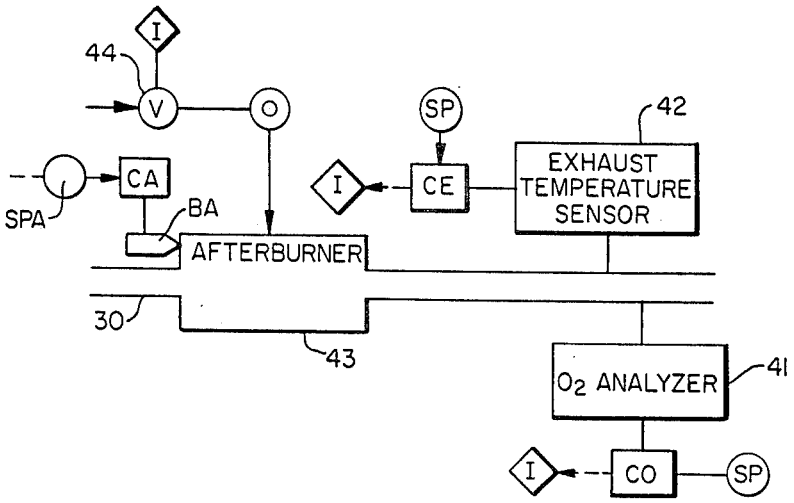
FIG. 2 is a partial schematic view of the exhaust from the furnace of FIG. 1 showing an afterburner therein.

The furnace as described in connection with FIG. 1 constitutes a furnace system which can be used only for operation in the excess air mode of operation, as will appear more clearly from the following description. If it is desired to operate in a pyrolysis mode, an afterburner must be added to complete the system. Such an addition to the furnace system is shown in FIG. 2, in which, in the exhaust gas outlet 30 there is inserted an afterburner 43 upstream of the oxygen analyzer 41 and the temperature sensor 42. The afterburner is a conventional afterburner having an air inlet from an air supply such as a fan drawing air from the atmosphere or from the preheated air in the shaft 25 through a control valve 44 with interlock I, and a burner BA with a controller CA the set point of which is set by set point controller SPA. The burner BA is provided for making it possible to have a flame present in the afterburner at all times for safety purposes, and if desired the firing rate can be increased from a minimum firing rate to some firing rate at which significant amounts of heat are added to the exhaust system through the afterburner.

The present invention will now be summarized in respect to the basic principles of operation in both the excess air mode and pyrolysis mode of incinerating sludge, and this will be followed by a more detailed description of specific embodiments of the invention.

In each mode of operation of the furnace there are three control loops, each having a controlled variable and a manipulated variable. Considering the excess air mode of operation, in the first control loop, the controlled variable is the hottest hearth temperature, which is established on the basis of the refractory properties of the furnace, the likelihood of clinkering of the ash, minimization of use of auxiliary fuel, and like considerations, and is usually around 1600° F. In one embodiment the manipulated variable of this loop is the flow rate of combustion air to the bottom hearth, and in another embodiment it is the firing rate of the burners below the hottest hearth.

In the second control loop, the controlled variable is the oxygen content of the exhaust gas from the furnace system which is established on the basis of the desired percent stoichiometric air, and in one embodiment the manipulated variable is the firing rate of the burners on the burner hearth or hearths below the hottest hearth, and in another embodiment it is the flow rate of air to the bottom hearth.

In the third control loop, the controlled variable is the temperature of the system exhaust gas, which is generally established on the basis of desired optimum system exhaust gas characteristics, and the manipulated variable is the firing rate of the burners on the hearth or hearths above the hottest hearth.

As a general principle, in one embodiment of the excess air mode of operation, to increase the temperature of the hottest hearth, the flow rate of the combustion air is decreased, and to decrease the temperature of the hottest hearth the flow rate of the combustion air is increased. To increase the oxygen content of the system exhaust gas, the firing rate of the burners on the burner hearth or hearths below the hottest hearth is increased, and to decrease the oxygen content the burning firing rate is reduced. To increase the temperature of the system exhaust gas, the firing rate of the burners on the hearth or hearths above the hottest hearth is increased, and to reduce the temperature the burning rate is reduced.

In a second embodiment of the excess air mode of operation to increase the temperature of the hottest hearth, the firing rate of the burners on the burner hearth or hearths below the hottest hearth is increased, and to decrease the temperature the firing rate is decreased. To increase the oxygen content of the system exhaust gas, the air flow to the bottom of the furnace is increased, and to decrease the oxygen content the air flow is decreased. The control of the temperature of the system exhaust gas is the same as in the first embodiment.

Considering the pyrolysis mode of operation, in the first control loop, the controlled variable is the hottest hearth temperature and the manipulated variable is the flow of air to the bottom of the furnace.

In the second control loop, the controlled variable is the system exhaust gas oxygen content and in a first embodiment, the manipulated variable is the flow of air to the afterburner and in a second embodiment, the manipulated variable is the firing rate of the burners above the hottest hearth.

In the third control loop, the controlled variable is the system exhaust gas temperature and in a first embodiment, the manipulated variable is the firing rate of the burners above the hottest hearth, and in a second embodiment, the manipulated variable is the flow of air to the afterburner.

As a general principle in one embodiment of the starved air mode, to increase the temperature of the hottest hearth, the flow rate of air is increased to the bottom of the furnace and to decrease the temperature, the flow of air to the bottom of the furnace is decreased. To increase the system exhaust gas oxygen content, the flow of air to the afterburner is increased and to decrease the oxygen content, the flow of air to the afterburner is decreased. To increase the system exhaust gas temperature, the firing rate of the burners on burner hearths above the hottest hearth is increased and to decrease the exhaust gas temperature, the firing rate of the burners above the hottest hearth is decreased.

In a second embodiment, to increase the hottest hearth temperature, the air flow rate to the bottom of furnace is increased, and to decrease the hottest hearth temperature, the air flow to the bottom of furnace is decreased. To increase the system exhaust gas oxygen content, the firing rate of the burners above the hottest hearth is increased, and to decrease the oxygen, the firing rate of the burners above the hottest hearth is decreased. To increase the system exhaust gas temperature, the air flow rate to the afterburner is decreased, and to decrease the system exhaust gas temperature, the air flow to the afterburner is increased.

By the increase of the firing rate of the burners or decrease of the firing rate of the burners is meant a change in the rate of auxiliary fuel consumption by the burners to cause a greater or lesser amount of heat to be added to the hearth, and the expression includes turning on a burner which is off or vice versa, i.e. a change from a zero consumption to a finite consumption rate or vice versa.

As a further general principle, if the first increase of the firing rate carried out on a burner hearth closest to the hottest hearth fails to achieve the desired correction in the controlled variable, the firing rate of the burners on the next higher or lower burner hearth is increased. If the first decrease of the firing rate carried out on a burner hearth most remote from the hottest hearth fails to achieve the desired correction in the controlled variable, the firing rate of the burners on the next closer burner hearth is decreased.

It is also desirable to have as many burners on (or fired) on a hearth as can be tolerated by the temperature control circuit. Thus on a burner hearth with three equal sized burners, it is preferred to have all three burners firing at one third of full capacity than only one burner firing at full capacity.

The preferred operation of the control system for the control of the operation of the furnace is for the control means, such as a logic control circuit, or the operator if the control is a manual control, to be monitoring all three control loops substantially simultaneously, and corrections made on a continuous and modulated basis.

In all modes of operation, the temperature controllers for the respective burner hearths ordinarily have a maximum set point that is lower than the hottest hearth temperature set point. There are situations in which a burner hearth may be permitted to be at a temperature equal to or above the temperature of the hottest hearth but in such an instance, the control signal to the hottest hearth scanner must be blocked or otherwise modified to avoid switching the hottest hearth control logic to a hearth with burners firing thereon.

THE EXCESS AIR MODE OF OPERATION

According to the basic concept of the present invention, in the first control loop, the temperature of the hottest hearth, which is the controlled variable, is sensed by means of the hottest hearth scanner 40 which senses the signals from temperature sensors $t_s$ located in the various hearths. This scanner determines which hearth is the hottest hearth and then the controller CH compares the temperature of the hottest hearth to the predetermined temperature set point for the hottest hearth.

In a first embodiment, the manipulated variable in the first control loop is the combustion air flow to the bottom of the furnace. If it is determined that the hottest hearth temperature differs from this set point, the air control valve 37 located in the air supply line to the bottom of the furnace is caused to operate to cause a change in air flow to the bottom of the furnace to thereby change the temperature of the hottest hearth to the predetermined set point value.

In the excess air mode, if the temperature of the hottest hearth exceeds the predetermined temperature set point value, the air valve 37 is opened somewhat to increase the air flow and thus decrease the temperature of the hottest hearth by quenching the hottest hearth with excess air and generally lowering the overall temperature of the furnace. On the other hand, if the temperature in the hottest hearth is below the set point, the air valve 37 is closed somewhat to decrease the air flow and thus increase the temperature of the hottest hearth to maintain it at its predetermined set point value.

In the second and third control loops the controlled variables, viz., the content of oxygen in the system exhaust gases and the system exhaust gas temperature, are both maintained at or above predetermined set point values. This is achieved by controlling the manipulated variables, namely the firing rate of the burners B located in certain preselected hearths above and below the hottest hearth. These burners are operated to control both the oxygen content and the exhaust gas temperature of the furnace at or above its set point values.

To simplify the explanation of how the latter variables are controlled, several assumptions will be made. First, it will be assumed that the number of hearths in the furnace is twelve as in FIG. 1 and that the fired hearths, i.e., those hearths containing burners to add heat to the furnace, are hearths Nos. 1, 3, 5, 7, 9 and 11. Further, the oxygen content represents the volume percent of oxygen in the system exhaust gas and indirectly represents the percent stoichiometric air, and it will be assumed that the furnace is operating under approximately 175% stoichiometric air conditions. It will be further assumed that the temperature of the uppermost hearth No. 1, i.e., the exhaust gases leaving the furnace, is set at 1000° F. and the temperature of the hottest hearth is set at 1600° F. These temperatures are predetermined and can be stored in the controller CE and temperature controller $C_H$, or be manually set therein.

For the sake of simplicity, it will be further assumed that at a particular instant of time, the hottest hearth as determined by the scanner is hearth No. 8 and that heat is being added by firing the burners B on the various firing hearths other than the hottest hearth under the control of the temperature controllers C. In this connection, it must be emphasized that where the hottest hearth is found to be a burner hearth, e.g. hearth 7 or 9, no auxiliary heat is added to that hearth, i.e., no burners are fired on that hearth. In addition to this, it must be pointed out that the temperature controllers for all of the fired hearths, other than the hottest hearth, have a maximum set point value, i.e. they will not normally be set to operate any higher than such value, which is some nominal value, say 100° F., less than the hottest hearth. This ensures that there is a clear difference between the temperature of the hottest hearth and the remaining hearths.

With the above points in mind, the control of the oxygen content in the system exhaust gases and the temperature of the system exhaust gases at or above a predetermined set point values will now be described.

In controlling the content of oxygen in the system exhaust gas, first the content of oxygen is analyzed by means of the oxygen sensor or analyzer 41 usually provided in the system exhaust line. This is compared to the oxygen set point value in the controller CO.

If the oxygen content is sensed to be below the oxygen set point, the temperature set point of the controller C for controlling the firing rate of burner(s) located on the next burner hearth below the hottest hearth is increased, burners B9 in this case, to raise the temperature on burner hearth 9. This in turn causes the temperature on the hottest hearth 8 to rise, and the hottest hearth controller CH will provide an indication that the manipulated variable, namely the combustion air flow to the bottom of the furnace must be increased. This increased flow rate raises the oxygen content in the exhaust gas. The firing rate of the burner(s) is increased until the oxygen set point is attained. However, if after raising the set point temperature of hearth No. 9 to its maximum temperature and the oxygen set point in the system exhaust gas is not reached, then the same operation is repeated on the next lower burner hearth or hearths below the hottest hearth until the oxygen set point is reached.

If the oxygen content is sensed to be above the set point value the reverse situation occurs. The set point temperature of the temperature controller C on the lowest hearth on which burners are firing, e.g. hearth 11, is first reduced which results in the reduction of flow of combustion air. If after the firing rate of the burners on such hearth is brought down to its minimum value or the burners are turned off, the oxygen set point is still not reached, a similar control action is taken on the next closer burner hearth to the hottest hearth, e.g. hearth 9. If after turning all burners below the hottest hearth off or reducing them to the lowest firing rate, it is observed that the oxygen content still exceeds the set point value, this means that a very dry autogenous sludge is being burned in the furnace and nothing can be done to lower the sensed oxygen content. This is why the sensed oxygen content may be permitted in some cases to be above its set point value.

In controlling the system exhaust gas temperature to a predetermined set point value, the system exhaust gas temperature is sensed by the exhaust temperature sensor 42 and compared to the set point value in the controller CO, which in this case is 1000° F.

If the exhaust temperature is sensed to be below the set point, the temperature set point of the controller C for controlling the firing rate of burner(s) located on the next burner hearth above the hottest hearth, i.e., hearth No. 7 in this particular instance, is increased to raise the temperature on the burner hearth 7. This in turn increases the temperature of the system exhaust gas. If after raising the set point temperature of the controller for burners B7 on hearth 7 to the maximum set point temperature, the sensed system exhaust gas temperature does not reach the set point temperature, the same operations are performed on the next burner hearth or hearths above the hottest temperature hearth, i.e., in this case first hearth 5 and then hearth 3, if necessary, until the exhaust temperature set point value is reached.

If the system exhaust gas temperature is sensed to be above the set point value, then the reverse situation occurs. The set point temperature of the temperature controller on the highest hearth on which burners are firing, e.g. hearth 5, is first reduced, which results in the reduction of the system exhaust gas temperature. If after the firing rate of the burners on such hearth is brought down to its minimum value or the burners are turned off, the system exhaust gas temperature is still not at its set point, a similar control action is taken on the next closer burner hearth to the hottest hearth, e.g. hearth 7, until the exhaust set point temperature is reached. All of the fired hearths may be turned off, if necessary to achieve the system exhaust gas set point temperature value. If this is still not achieved, after reducing the firing rate to the lowest rate or turning off all of the burners on the firing hearths, this is a sign that dry autogenous sludge is being burned and nothing can be done to bring the temperature of the system exhaust gas down to its set point value by controlling the auxiliary fuel to the burners. Thus, in such special cases, the furnace must be operated above its system exhaust gas temperature set point.

In a second embodiment, the controlled variable in the first control loop is again the hottest hearth temperature; however the primary manipulated variable is the firing rate of the burners on the hearth or hearths below the hottest hearth. Thus, if it is determined by the hottest hearth temperature controller CH that the hottest hearth temperature is less than the set point temperature, the firing rate of the burner(s) on the next burner hearths below the hottest hearth is increased in the same manner as in the second control loop in the first embodiment described above. On the other hand, if the hottest hearth temperature is sensed to be greater than the set point value, the firing rate of the burner(s) on the burner hearth(s) below the hottest hearth are decreased in the same manner as in the second control loop in the first embodiment. However, if this burner firing rate control does not succeed in bringing the hottest hearth temperature down to the set point value, then a secondary manipulated variable is used, which is the air flow to the bottom of the furnace. To use this, an oxygen override control means is set into operation to control valve 37 so as to open it further to introduce more air into the bottom portion of the furnace to quench or lower the temperature of the hottest hearth to its set point value. According to this override mode of operation, if the temperature of the hottest hearth is sensed by the scanner 40 as being above its set point value after lowering the firing rate of the burners to their lowest value or turning them off, the valve 37 is opened to permit more air to be introduced at the bottom of the furnace until the temperature of the hottest hearth is lowered to its set point.

During this oxygen override control mode, the exhaust gas oxygen content will be greater than the oxygen set point value. Should the conditions of incineration change so that the sensed exhaust gas oxygen content falls back to the set point values, then the control logic for the hottest hearth reverts back to using the firing rate of the burner or burners below the hottest hearth as the manipulated variable.

In the second control loop of this second embodiment, the controlled variable is the system exhaust gas oxygen content and the manipulated variable is the air flow to the bottom of the furnace. According to this embodiment, the oxygen content in the system exhaust gas is sensed by analyzer 41 and compared to the oxygen set point value in controller CO. If the oxygen is sensed as being less than the set point value, the air flow rate to the bottom of the furnace is increased, whereas if the oxygen is sensed as being greater than the set point value, the air flow rate to the bottom of the furnace is decreased. The oxygen content in the system exhaust gas is sensed by means of an oxygen analyzer, is compared to a set point in a controller and the valve 37 in the air flow line is caused to open somewhat further or close somewhat further, depending upon whether the sensed oxygen content is below or above the set point value, respectively. This control loop can be overridden by the oxygen override control of the first control loop of this embodiment, and in this case the sensed oxygen content will be above the set point oxygen value.

The third control loop for controlling the system exhaust gas temperature is the same as in the first embodiment.

It should be realized that although the furnace operations have been set forth in a sequential manner, the various operations discussed above need not be performed in the sequential manner described, but rather can be reversed or changed so that very many different combinations of the controlled and manipulated parameters may be used to achieve the desired end result. Thus, in the conventional incineration mode discussed above, rather than starting with the control of the hottest hearth, the control means may start with the control of oxygen followed by controlling the hottest hearth and finally the temperature of the exhaust may be controlled or the operations carried out substantially simultaneously on a continuous or automated basis.

In respect to the reference to burners on the various firing hearths, it must be pointed out that ordinarily more than one burner is fired to improve uniform heat distribution in incinerating the sludge and also in avoiding thermal stresses or damage to the furnace as could be done by firing a single burner at maximum value as opposed to firing three separate burners, e.g. at a lesser value. Also, it should be emphasized that when the furnace is operating in the excess air mode, all reference to the exhaust gas refers to the gas leaving the furnace, whether or not there is an afterburner, since the afterburner normally serves simply to increase the holding time of the gases.

THE PYROLYSIS MODE

The pyrolysis mode is essentially carried out on same principles of operation as in the excess air mode, except in the pyrolysis mode, a limited amount of air is introduced into the bottom of the furnace to maintain substoichiometric or starved air conditions in the furnace to pyrolyze the organic materials. The furnace gases (pyrogas) are then directed to an afterburner in which additional air is introduced to complete burning of the pyrogas. Under ordinary circumstances, the sensed system exhaust gas oxygen content is that corresponding to about 140% stoichiometric air.

In the following discussion of the operation in the pyrolysis mode, the same assumptions will be made as were made in the discussion of the excess air mode of operation.

In the operation in the pyrolysis mode, in the first control loop, the temperature of the hottest hearth, which is the controlled variable is sensed by means of the hottest hearth scanner. This scanner determines which hearth is the hottest hearth and then compares the temperature of the hottest hearth to the predetermined set point temperature for the hottest hearth. The manipulated variable is the combustion air flow to the bottom of the furnace. If it is determined that the hottest hearth temperature exceeds the predetermined temperature set point value, the air valve 37 is closed somewhat to decrease the air flow and thus decrease the temperature of the hottest hearth by reducing the oxygen available for combustion on the hottest hearth. On the other hand, if the temperature in the hottest hearth is below the set point, the air valve is opened somewhat to increase the air flow and thus increase the temperature of the hottest hearth to maintain it at its predetermined set point value.

In the second control loop, the controlled variable is the oxygen content of the system exhaust gas. In a first embodiment of the pyrolysis mode of operation the manipulated variable in the second control loop is the air flow to the afterburner 43, and in a second embodiment the manipulated variable is the firing rate of the burners B on the burner hearth or hearths above the hottest hearth.

In the first embodiment, after sensing the oxygen content by the oxygen analyzer 41 and comparing it with the set point value in controller CO, if it is determined that the amount of oxygen in the exhaust gases from the afterburner 43, i.e. the system exhaust gases, is below the set point, the air flow to the afterburner 43 is increased by opening the valve 44 somewhat until the set point value of the oxygen controller CO is reached. If it is determined that the amount of oxygen in the exhaust gases from the afterburner is above the set point, the air flow to the afterburner 43 is reduced by closing the valve 44 somewhat until the set point value of the oxygen is reached.

In the second embodiment, after sensing the oxygen content by the oxygen analyzer 41 and comparing it with the set point value in controller CO, it is determined that the amount of oxygen in the exhaust gases from the afterburner is below the set point, the firing rate of the burner or burners located on the next burner hearth above the hottest hearth is increased, burners B7 in this case. This in turn causes the temperature of the system exhaust gas to increase and the second embodiment of the third control loop, described below, will act to increase the air flow to the afterburner, thus increasing the oxygen content in the system exhaust gas. If after raising the set point temperature of the controller for burners B7 on hearth 7 to the maximum set point, the system exhaust gas oxygen content is still not sensed as reaching the set point, the same operations are performed on the next burner hearth or hearths above the hottest hearth, i.e. in this case first hearth 5 and then hearth 3, if necessary, until the system exhaust oxygen set point value is reached.

If the system exhaust gas oxygen content is sensed to be above the set point value, then the reverse situation occurs. The set point temperature of the temperature controller on the highest hearth on which burners are firing, e.g. hearth 5, is first reduced, which results in the reduction of the system exhaust gas oxygen content due to the operation of the third control loop. If after the firing rate of the burners on such hearth is brought down to its minimum value or the burners are turned off, the system exhaust gas oxygen content is still not at its set point value, a similar control action is taken on the next closer burner hearth to the hottest hearth, e.g. hearth 7, until the system exhaust gas oxygen content reaches the set point value.

In the third control loop, the controlled variable is the temperature of the system exhaust gas. In the first embodiment of the pyrolysis mode of operation, the primary manipulated variable is the firing rate of the burners above the hottest hearth, and in the second embodiment the manipulated variable is the air flow to the afterburner.

In the first embodiment, after sensing the temperature of the system exhaust gases by the temperature sensor 42 and comparing it with the set value in controller CE, if it is determined that the temperature is below the set point temperature, the temperature set point of the controller C for controlling the firing rate of the burner or burners located on the next burner hearth above the hottest hearth, i.e. the hearth 7, is increased to raise the temperature on the burner hearth. This in turn increases the temperature of the system exhaust gas. If after raising the set point temperature of the controller for the burners B7 on the hearth 7 to the maximum set point temperature, the sensed temperature of the system exhaust does not reach the set point temperature, the same operations are performed on the next higher burner hearth or hearths above the hottest hearth, i.e. in this case hearth 5 and then hearth 3, if necessary, until the system exhaust gas temperature set point value is reached.

Figure 3:
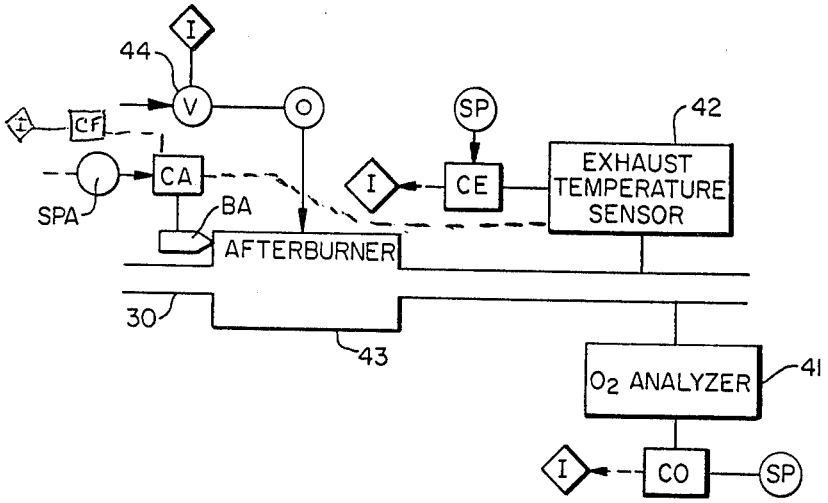
FIG. 3 is a partial schematic view of a modified form of FIG. 2.

The operation can be modified to increase the flexibility of the system, for example to increase the response speed to a sudden drop of the system exhaust gas temperature. As shown in FIG. 3, the burner controller CA for the afterburner BA is controlled in response to the temperature sensed by the system exhaust gas temperature sensor 42. A firing rate controller CF is connected to the burner controller CA for sensing the firing rate at which the burner BA is being fired under the control of controller CA and providing an output when that firing rate rises above a predetermined set point value.

If it is determined that the temperature of the system exhaust gas is below the set point temperature therefor, the firing rate of the afterburner burner BA is increased. In response to this increase, the controller CF output indicates that the rate is above the predetermined set point value, and in response thereto, the burner or burners on the burner hearths above the hottest hearth are controlled to increase the firing rate thereof in the manner described hereinbefore. When the temperature of the system exhaust gas reaches the set point, and the firing rate of the burner BA returns to its initial set value, the increase of the firing rate of the burners on the burner hearths above the hottest hearth is discontinued. The reverse sequence of operation takes place when the temperature of the system exhaust gas increases.

If the system exhaust gas temperature is sensed to be above the set point value, then the reverse operation first occurs. The set point temperature of the temperature controller on the highest hearth on which burners are firing, e.g. hearth 5, is first reduced, which results in the reduction of the system exhaust gas temperature. If after the firing rate of the burners on such hearth is brought down to its minimum value or the burners are turned off, the system exhaust gas temperature is still not at its set point, a similar control action is taken on the next closer burner hearth to the hottest hearth, e.g.

hearth 7, until the set point temperature of the system exhaust gas is reached.

In this first embodiment of the pyrolysis mode of operation, if desired, air flow to the afterburner can be provided as a secondary manipulated variable. This takes the form of an oxygen override which responds to the condition where all of the burners on the burner hearths above the hottest hearth have been reduced to the lowest firing rate or turned off, and the sensed temperature of the system exhaust gas still has not fallen to the set point temperature. In such case the valve 44 is opened somewhat to admit more air to the afterburner, and this is continued until the set point temperature of the system exhaust gas is reached. In this situation, the sensed oxygen may rise above the oxygen set point value, but this is ignored. It is also possible that this oxygen override control loop can be used to limit the system exhaust temperature from exceeding a maximum temperature, such as 1600° F., where deleterious thermal stresses may result.

In a similar manner to that described earlier in respect to the oxygen override in the incineration mode, the oxygen override control mode is only used while the exhaust gas oxygen content is greater than the set point. Once the sensed oxygen content falls back to the set point value, the control logic for the system exhaust gas temperature reverts back to the burner firing rate as the manipulated variable.

In the second embodiment, after sensing the temperature of the system exhaust gases by the temperature sensor 42, and comparing it with the set point value in controller CE, if it is determined that the temperature is below the set point value, the valve 44 for the air supply to the afterburner 43 is closed somewhat to reduce the flow of air to the afterburner. This will cause an increase in the temperature of the system exhaust gas.

On the other hand, if it is determined that the system exhaust gas temperature is above the set point value, the valve 44 for the air supply to the afterburner is opened somewhat to increase the flow of air to the afterburner, which will cause a decrease in the temperature of the system exhaust gas.

EXAMPLE 1

To operate the furnace system of FIG. 1 in the excess air mode, the following logic sequence is one sequence which can be followed. It is assumed that the furnace system of FIG. 1 is in operation, i.e., waste material is being fed through the hearths and the temperature profile of the furnace is substantially according to the desired operating conditions, and combustion air is flowing in through the inlet 31 in the bottom hearth and system exhaust gas is flowing out through the exhaust 30.

The sequence of logic steps is as follows:

10. Measure the temperature of all hearths by temperature sensors ts and system exhaust gas temperature by sensor 42.
20. Determine temperature of the hottest hearth by scanner 40.
30. Compare the temperature of the hottest hearth to hottest hearth set point temperature in controller CH.
40. If hottest hearth temperature is equal to the set point temperature, go to step 110.
50. If hottest hearth temperature is less than the set point temperature, go to step 70.
60. If hottest hearth temperature is greater than set point temperature, go to step 90.
70. Close valve 37 somewhat to decrease air flow rate to bottom hearth.
80. Go to step 10.
90. Open valve 37 somewhat to increase air flow rate to bottom hearth.
100. Go to step 10.
110. Determine hearth number of hottest hearth by scanner 40.
120. Measure oxygen in system exhaust gas by analyzer 41.
130. Compare measured oxygen to set point in controller CO.
140. If system exhaust gas oxygen content is equal to set point, go to step 230.
150. If system exhaust gas oxygen content is less than set point, go to step 170.
160. If system exhaust gas oxygen is greater than set point, go to step 190.
170. Increase set point on controller for burner or burners on burner hearth or hearths below hottest hearth, as described hereinbefore, to increase firing rate of burners on burner hearths below hottest hearth.
180. Go to step 10.
190. Read the controllers for the burners on hearths below the hottest hearth to see if they are at the minimum set point to determine if all burners below the hottest hearth are off or on minimum firing rate.
200. If yes, go to step 230; if no, go to step 210.
210. Reduce set point on controller for burner or burners on burner hearth or hearths below the hottest hearth, as described hereinbefore, to decrease the firing rate on burner hearths below the hottest hearth.
220. Go to step 10.
230. Compare the temperature of the system exhaust gas to set point temperature in controller CE.
240. If system exhaust gas temperature is equal to set point temperature, go to step 10.
250. If system exhaust gas temperature is less than set point temperature, go to step 270.
260. If system exhaust gas temperature is greater than set point temperature, go to step 290.
270. Increase the set point on the controller for burner or burners on burner hearths above the hottest hearth, as described hereinbefore, to increase the firing rate on burner hearths above the hottest hearth.
280. Go to step 10.
290. Reduce the set point on the controller for the burner or burners on burner hearths above the hottest hearth, as described hereinbefore, to reduce the firing rate on burner hearths above the hottest hearth.
300. Go to step 10.

EXAMPLE 2

The furnace system of FIG. 1 can be operated in the excess air mode, by following a logic sequence different from that of Example 1. Again it is assumed that the furnace system of FIG. 1 is in operation as in Example 1.

The sequence of logic steps which follows differs from that of Example 1 in that the system waste gas oxygen content control loop is examined first and the hottest hearth temperature control loop second:

10. Measure the temperature of all hearths by temperature sensors ts and system exhaust gas temperature by sensor 42.

20. Determine temperature of the hottest hearth by scanner 40.
30. Determine hearth number of hottest hearth by scanner 40.
40. Measure oxygen in system exhaust gas by analyzer 41.
50. Compare measured oxygen to set point in controller CO.
60. If system exhaust gas oxygen content is equal to set point, go to step 130.
70. If system exhaust gas oxygen content is less than set point, go to step 90.
80. If system exhaust gas oxygen is greater than set point, go to step 110.
90. Increase set point on controller for burner or burners on burner hearth or hearths below hottest hearth, as described hereinbefore, to increase firing rate of burners on burner hearths below hottest hearth.
100. Go to step 10.
110. Read the controllers for the burners on hearths below the hottest hearth to see if they are at the minimum set point to determine if all burners below the hottest hearth are off or on minimum firing rate.
120. If yes, go to step 150; if no, go to step 130.
130. Reduce set point on controller for burner or burners on burner hearth or hearths below the hottest hearth, as described hereinbefore, to decrease the firing rate on burner hearths below the hottest hearth.
140. Go to step 10.
150. Compare the temperature of the hottest hearth to hottest hearth set point temperature in controller CH.
160. If hottest hearth temperature is equal to the set point temperature, go to step 230.
170. If hottest hearth temperature is less than the set point temperature, go to step 190.
180. If hottest hearth temperature is greater than set point temperature, go to step 210.
190. Close valve 37 somewhat to decrease air flow rate to bottom hearth.
200. Go to step 10.
210. Open valve 37 somewhat to increase air flow rate to bottom hearth.
220. Go to step 10.
230. Compare the temperature of the system exhaust gas to set point temperature in controller CE.
240. If system exhaust gas temperature is equal to set point temperature, go to step 10.
250. If system exhaust gas temperature is less than set point temperature, go to step 270.
260. If system exhaust gas temperature is greater than set point temperature, go to step 290.
270. Increase the set point on the controller for burner or burners on burner hearths above the hottest hearth, as described hereinbefore, to increase the firing rate on burner hearths above the hottest hearth.
280. Go to step 10.
290. Reduce the set point on the controller for the burner or burners on burner hearths above the hottest hearth, as described hereinbefore, to reduce the firing rate on burner hearths above the hottest hearth.
300. Go to step 10.

EXAMPLE 3

The furnace system of FIG. 1 can be operated in the excess air mode by using a logic sequence in which in the control loops manipulated variables different from those of Example 1 and 2 are used. Again it will be assumed that the furnace system of FIG. 1 is in operation as in Example 1. The manipulated variable for the hottest hearth temperature control will be the change of firing rate of the burners below the hottest hearth, and the manipulated variable for the system exhaust gas oxygen content will be the combustion air flow to the bottom hearth.

The sequence of logic steps is as follows:

10. Measure the temperature of all hearths by temperature sensors ts and system exhaust gas temperature by sensor 42.
20. Determine temperature of the hottest hearth by scanner 40.
30. Determine hearth number of hottest hearth by scanner 40.
40. Measure oxygen in system exhaust gas by analyzer 41.
50. Compare measured oxygen to set point in controller CO.
60. If system exhaust gas oxygen content is equal to set point, go to step 150.
70. If system exhaust gas oxygen content is less than set point, go to step 90.
80. If system exhaust gas oxygen is greater than set point, go to step 110.
90. Open valve 37 somewhat to increase air flow rate to bottom hearth.
100. Go to step 10.
110. Read the controllers for the burners on hearths below the hottest hearth to see if they are at the minimum set point to determine if all burners below the hottest hearth are off or on minimum firing rate.
120. If yes, go to step 150; if no, go to step 130.
130. Close valve 37 somewhat to decrease air flow rate to bottom hearth.
140. Go to step 10.
150. Compare the temperature of the hottest hearth to hottest hearth set point temperature in controller CH.
160. If hottest hearth temperature is equal to the set point temperature, go to step 270.
170. If hottest hearth temperature is less than the set point temperature, go to step 190.
180. If hottest hearth temperature is greater than set point temperature, go to step 210.
190. Increase set point on controller for burner or burners on burner hearth or hearths below hottest hearth, as described hereinbefore, to increase firing rate of burners on burner hearths below hottest hearth.
200. Go to step 10.
210. Read the controllers for the burners on the hearths below the hottest hearth to see if they are at the minimum set point to determine if all burners below the hottest hearth are off or on minimum firing rate.
220. If yes, go to step 250; if no, go to step 230.
230. Reduce set point on controller for burner or burners on burner hearth or hearths below the hottest hearth, as described hereinbefore, to decrease the firing rate on burner hearths below the hottest hearth.
240. Go to step 10.
250. Increase set point of oxygen content of system exhaust gas on controller CO.
260. Go to step 10.
270. Measure exhaust temperature by temperature sensor 42.
280. Compare the temperature of the system exhaust gas to set point temperature in controller CE.
290. If system exhaust gas temperature is equal to set point temperature, go to step 10.

300. If system exhaust gas temperature is less than set point temperature, go to step 320.
310. If system exhaust gas temperature is greater than set point temperature, go to step 340.
320. Increase the set point on the controller for burner or burners on burner hearths above the hottest hearth, as described hereinbefore, to increase the firing rate on burner hearths above the hottest hearth.
330. Go to step 10.
340. Reduce the set point on the controller for the burner or burners on burner hearths above the hottest hearth, as described hereinbefore, to reduce the firing rate on burner hearths above the hottest hearth.
350. Go to step 10.

EXAMPLE 4

To operate the furnace system of FIG. 2 in the pyrolysis mode, the following logic sequence is one sequence which can be followed. It is assumed that the furnace system of FIG. 2 is in operation, i.e., waste material is being fed through the hearths and the temperature profile of the furnace and afterburner is substantially according to the desired operating conditions, and combustion air is flowing in through the inlet 31 in the bottom hearth and also into the afterburner and system exhaust gas is flowing out through the afterburner 43.

The sequence of logic steps is as follows:

10. Measure the temperature of all hearths by temperature sensors ts and system exhaust gas temperature by sensor 42.
20. Determine temperature of the hottest hearth by scanner 40.
30. Compare the temperature of the hottest hearth to hottest hearth set point temperature in controller CH.
40. If hottest hearth temperature is equal to the set point temperature, go to step 110.
50. If hottest hearth temperature is less than the set point temperature, go to step 70.
60. If hottest hearth temperature is greater than set point temperature, go to step 90.
70. Open valve 37 somewhat to increase air flow rate to bottom hearth.
80. Go to step 10.
90. Close valve 37 somewhat to decrease air flow rate to bottom hearth.
100. Go to step 10.
110. Determine hearth number of hottest hearth by scanner 40.
120. Measure oxygen in system exhaust gas by analyzer 41.
130. Compare measured oxygen to set point in controller CO.
140. If system exhaust gas oxygen content is equal to set point, go to step 240.
150. If system exhaust gas oxygen content is less than set point, go to step 170.
160. If system exhaust gas oxygen is greater than set point, go to step 190.
170. Increase the flow of afterburner air by opening afterburner air valve 44 somewhat.
180. Go to step 10.
190. Compare system exhaust gas temperature with system exhaust gas set point temperature in controller CE.
200. If system exhaust gas temperature is less than set point temperature, go to step 220.
210. If system exhaust gas temperature is equal to or above set point temperature, go to 300.
220. Decrease the flow of afterburner air by opening afterburner air valve 44 somewhat.
230. Go to step 10.
240. Compare the temperature of the system exhaust gas to set point temperature in controller CE.
250. If system exhaust gas temperature is equal to set point temperature, go to step 10.
260. If system exhaust gas temperature is less than set point temperature, go to step 280.
270. If system exhaust gas temperature is greater than set point temperature, go to step 300.
280. Increase the set point on the controller for burner or burners on burner hearths above the hottest hearth, as described hereinbefore, to increase the firing rate on burner hearths above the hottest hearth.
290. Go to step 10.
300. Reduce the set point on the controller for the burner or burners on burner hearths above the hottest hearth, as described hereinbefore, to reduce the firing rate on burner hearths above the hottest hearth.
310. Go to step 10.

EXAMPLE 5

It is also possible to use intermediate control loops and manipulated variables within the main control loops illustrated previously. In this third embodiment of the pyrolysis mode of operation, the first control loop has the hottest hearth as the controlled variable with air flow to the bottom of the furnace as the manipulated variable. The second control loop is for the exhaust gas oxygen content with the sensed oxygen being the controlled variable and air flow to the afterburner as the manipulated variable. The third control loop is the system exhaust gas temperature with the system exhaust gas temperature as the controlled variable and the firing rate of the afterburner burner(s) BA as the manipulated variable. The fourth control loop maintains the firing rate of the afterburner burner(s) at set point with the firing rate of this burner as the controlled variable and the firing rate of the burners above the hottest hearth as the manipulated variable. The first two control loops have been previously described and are not repeated here.

In the third control loop, as the system exhaust gas temperature falls below the set point, the firing rate of the afterburner burner(s) is increased. When the sensed temperature rises above the set point, the firing rate of this burner is decreased.

In the fourth control loop, as the firing rate of the afterburner burner(s) exceed the set point, the firing rate of the burners above the hottest hearth is increased. As the firing rate of the afterburner burner(s) falls below the set point value, the firing rate of the burners above the hottest hearth are decreased if the burners above the hottest hearth have been decreased to their minimum value or have been turned off, and the sensed system exhaust temperature still is above the set point (or alternately tries to exceed a maximum set point), then the oxygen override control loop is employed which has been described previously.

The sequence of logic steps for this control loop is as follows:

10. Measure the temperature of all hearths by temperature sensors $T_s$ and system exhaust gas temperature by sensor 42.

20. Determine temperature of the hottest hearth by scanner 40.
30. Compare the temperature of the hottest hearth to hottest hearth set point temperature in controller CH.
40. If hottest hearth temperature is equal to the set point temperature go to step 110.
50. If hottest hearth temperature is less than the set point temperature, go to step 70.
60. If hottest hearth temperature is greater than set point temperature go to step 90.
70. Open valve 37 somewhat to increase the air flow rate to bottom hearth.
80. Go to step 10.
90. Close valve 37 somewhat to decrease the air flow rate to bottom hearth.
100. Go to step 10.
110. Determine hearth number of hottest hearth by scanner 40.
120. Measure oxygen in system exhaust gas by analyzer 41.
130. Compare measured oxygen to set point in controller CO.
140. If system exhaust gas oxygen content is equal to set point, go to step 210.
150. If system exhaust gas oxygen content is less than set point, go to step 170.
160. If system exhaust gas oxygen is greater than set point, go to step 190.
170. Increase the air flow to the afterburner by opening afterburner air valve 44 somewhat.
180. Go to step 10.
190. Decrease the air flow to the afterburner.
200. Go to step 10.
210. Compare the temperature of the system exhaust gas to set point temperature in controller CE.
220. If system exhaust gas temperature is equal to set point temperature go to step 300.
230. If system exhaust gas temperature is less than set point temperature go to step 250.
240. If system exhaust gas temperature is greater than set point temperature go to step 270.
250. Increase the set point on the controller for the afterburner burner or burners BA as described hereinbefore, to increase the firing rate of the afterburner or burners.
260. Go to step 10.
270. If the afterburner burner or burners is at low fire or off, go to step 300.
280. Dccrease the set point on the controller for the afterburner burner or burners, as described hereinbefore, to reduce the firing rate of the afterburner burner or burners.
290. Go to step 10.
300. Determine the firing rate of the afterburner burner or burners by the output of afterburner burner controller CA.
310. Compare the firing rate of the afterburner burner or burners with the set point value in controller CF.
320. If the firing rate of the afterburner burner or burners is equal to the set point, go to step 10.
330. If the firing rate of the afterburner burner or burners is less than the set point, go to step 350.
340. If the firing rate of the afterburner burner or burners is greater than the set point, go to step 390.
350. Reduce the set point on the controller for the burner or burners on burner hearths above the hottest hearth, as described hereinbefore, to reduce the firing rate on burner hearths above the hottest hearth.
360. Determine if the firing rate of all of the burners above the hottest hearth are at minimum fire or off.
370. If yes, then initiate the oxygen override control loop described hereinbefore.
380. If no, go to step 10.
390. Increase the set point on controller for burner or burners on burner hearth or hearths above the hottest hearth as described hereinbefore, to increase firing rate of burners on burner hearths above the hottest hearth.
400. Go to step 10.

In the foregoing examples, Example 2 shows that the control loops can be carried out in different orders, and it should be understood that this is true of the operation in the pyrolysis mode. Example 3 uses the same controlled variables, but uses different manipulated variables to control these controlled variables. It should be understood that other manipulated variables can be used to control the controlled variables in both the excess air mode and in the pyrolysis mode, and that the invention is not limited just to the particular manipulated variables described in connection with the various controlled variables. What is important is that the manipulated variables be such as to be usable to control the controlled variables, and that the controlled variables be controlled at the desired set points, i.e., the hottest hearth be controlled to the predetermined hottest hearth set point, and the system exhaust gas oxygen content and temperature be controlled at or above their predetermined set point values.

From the foregoing, it will be seen that the present invention provides many distinct advantages in the art of controlling the temperature profile of multiple hearth systems, where the combustion air is introduced at the bottom portion of the furnace to combust the solid materials. These advantages of Applicant's invention are multiform.

Firstly, the use of the scanning technique to sense the hottest hearth has clear advantages over the older technique in which a single hearth was selected as the main combustion hearth.

More specifically, according to the prior art, an operator of such furnace will ordinarily be directed to operate the furnace with one hearth selected as the main combustion hearth. However, in an actual practice, this selected main combustion hearth is not always the hottest hearth. This is partially due to the change in the quality of the sludge, e.g., from dry to wet or vice-versa, etc. As a result the hottest hearth may shift and still the operator may continue to modify the throughput of the sludge to accommodate the selected main combustion hearth, which is not always the hottest hearth. By using a scanner according to the present invention, the hottest hearth is always pinpointed, which eliminates the possibility of the operator governing the throughput of the sludge by a single hearth, which is actually not the main combustion hearth or the hottest hearth.

Further, by using Applicant's scanning technique to determine the hottest hearth and controlling the temperature of the hottest hearth at a predetermined temperature set point value, the throughput or the feed rate of the sludge through the furnace can be carried out on a more predictable and constant basis since the hottest hearth is always known and its temperature always maintained at a predetermined temperature value.

Also, the other key factor in Applicant's invention, is the control of the hottest hearth; the control of the oxygen exhaust content and the control of the system exhaust temperature as described above. All of these parameters have been orchestrated to control the furnace system at an optimum temperature profile to ensure the most efficient combustion in these older multiple hearth systems in which the combustion air is introduced at the bottom portion of the furnace to incinerate the sludge. Thus, while control of the exhaust temperature and the oxygen content have been known in isolation, no systematic body of knowledge exists which would permit a furnace operator to maintain maximum sludge throughput by use of the control parameters according to the present invention and thus avoiding the prior art problems outlined above.

What is claimed:

1. In a method for controlling the operation of a multiple hearth furnace system for efficiently incinerating combustible materials, said furnace system having a plurality of superimposed hearths to which solid combustible materials are introduced at the upper portion of the furnace system and passed downward from hearth to hearth for being incinerated and the ash is discharged at the bottom of said furnace system through an ash outlet, at least some of said hearths being burner hearths having at least one burner thereon for adding heat to said burner hearths, and said furnace system having means for introducing combustion air at the bottom thereof and the unreacted combustion air and the gaseous products of combustion flowing upwardly countercurrent to the flow of solid combustible materials and being exhausted as system exhaust gas from the top of the furnace system, the improvement comprising:

scanning the temperatures of combustible material handling hearths and determining which is the hottest hearth;

controlling the temperature of the thus determined hottest hearth at a predetermined temperature set point value by regulating at least one manipulatable variable;

maintaining the oxygen content of the system exhaust gas at least as high as a predetermined set point value by regulating at least one of said manipulatable variables; and maintaining the system exhaust gas temperature at least as high as a predetermined set point value by regulating at least one of said manipulatable variables;

said manipulation variable being taken from among the operations of controlling the combustion air flow to the bottom of the furnace, controlling the firing rate of the burner on the burner hearth or hearths above the thus determined hottest hearth, controlling the firing rate of the burner on the burner hearth or hearths below the thus determined hottest hearth, and controlling flow of afterburner air to the system exhaust gas.

2. The improvement as claimed in claim 1 in which said furnace system is operated in the excess air mode by maintaining the oxygen content of the system exhaust gas above a value necessary to ensure supply of sufficient combustion air to the bottom of the furnace system to operate the furnace system at super-stoichiometric conditions.

3. The improvement as claimed in claim 2 in which for controlling the temperature of the hottest hearth the combustion air flow to the bottom of the furnace system is controlled to increase the combustion air flow to decrease the temperature of the hottest hearth and is controlled to decrease the combustion air flow to increase the temperature of the hottest hearth.

4. The improvement as claimed in claim 2 in which for controlling the temperature of the hottest hearth the firing rate of at least one burner on the hearth or hearths below the hottest hearth is controlled to increase the firing rate to increase the temperature of the hottest hearth and to decrease the firing rate to decrease the temperature of the hottest hearth.

5. The improvement as claimed in claim 4 further comprising, if the decrease of the firing rate fails to control the hottest hearth temperature to the set point value, increasing the combustion air flow to the bottom of the furnace.

6. The improvement as claimed in claim 2 in which for maintaining the oxygen content of the system exhaust gas the firing rate of at least one burner on the hearth or hearths below the hottest hearth is controlled to increase the firing rate for causing the temperature of the hottest hearth to increase and in response thereto increasing the combustion air flow to the bottom of the furnace, thereby increasing the oxygen content of the system exhaust gas, and is controlled to decrease the firing rate for causing the temperature of the hottest hearth to decrease and in response thereto decreasing the combustion air flow to the bottom of the furnace, thereby decreasing the oxygen content of the system exhaust gas.

7. The improvement as claimed in claim 2 in which for maintaining the oxygen content of the system exhaust gas the combustion air flow to the bottom of the furnace system is controlled to increase the combustion air flow to increase the oxygen content and is controlled to decrease the combustion air flow to decrease the oxygen content.

8. The improvement as claimed in claim 2 in which for maintaining the system exhaust gas temperature the firing rate of at least one burner on the hearth or hearths above the hottest hearth is controlled to increase the firing rate to increase the temperature of the system exhaust gas and is controlled to decrease the firing rate to decrease the temperature of the system exhaust gas.

9. The improvement as claimed in claim 1 in which said furnace system is operated in the pyrolysis mode, said furnace system comprising a solid combustible material handling multiple hearth furnace and an afterburner in which the multiple hearth furnace is operated under sub-stoichiometric conditions and the afterburner is operated at greater than stoichiometric conditions, such that the system exhaust gases leaving the afterburner contain unreacted oxygen.

10. The improvement as claimed in claim 9 in which for controlling the temperature of the hottest hearth the combustion air flow to the bottom of the furnace system is controlled to decrease the combustion air flow to decrease the temperature of the hottest hearth and is controlled to increase the combustion air flow to increase the temperature of the hottest hearth.

11. The improvement as claimed in claim 9 in which for maintaining the oxygen content of the system exhaust gas the flow of afterburner air is controlled to increase the afterburner air flow to increase the oxygen content and is controlled to decrease the afterburner air to decrease the oxygen content.

12. The improvement as claimed in claim 9 in which for maintaining the system exhaust gas temperature the firing rate of at least one burner on the hearth or hearths above the hottest hearth is controlled to increase the firing rate to increase the temperature of the system exhaust gas and is controlled to decrease the firing rate to decrease the temperature of the system exhaust gas.

13. The improvement as claimed in claim 12 further comprising, if the decrease of the firing rate fails to control the system exhaust gas temperature, increasing the afterburner air flow.

14. The improvement as claimed in claim 12 in which an afterburner burner is provided for adding heat to the system exhaust gas, and said improvement further comprises controlling the firing rate of said afterburner burner to increase the firing rate thereof and when said firing rate is increased, increasing the firing rate of at least one burner on the hearth or hearths above the hottest hearth to increase the temperature of the system exhaust gas, and controlling the firing rate of said afterburner burner to decrease the firing rate thereof and when said firing rate is decreased, decreasing the firing rate of at least one burner on the hearth or hearths above the hottest hearth to decrease the temperature of the system exhaust gas.

15. The improvement as claimed in claim 9 in which for maintaining the oxygen content of the system exhaust gas the firing rate of at least one burner on the hearth or hearths above the hottest hearth is controlled to increase the firing rate for causing the temperature of the system exhaust gas to increase and in response thereto increasing the afterburner air flow, thereby increasing the oxygen content of the system exhaust gas, and is controlled to decrease the firing rate for causing the temperature of the system exhaust gas to decrease and in response thereto decreasing the afterburner air flow, thereby decreasing the oxygen content of the system exhaust gas.

16. The improvement as claimed in claim 9 in which for maintaining the system exhaust gas temperature the flow of afterburner air is controlled to increase the afterburner air flow to increase the system exhaust gas temperature and is controlled to decrease the afterburner air to decrease the system exhaust gas temperature.

17. The improvement as claimed in claim 1 in which the steps are performed in the order recited.

18. The improvement as claimed in claim 1 in which the controlling of the firing rate of the burner on the burner hearth or hearths comprises, when increasing the firing rate, first increasing the firing rate of at least one burner on the burner hearth closest to the thus determined hottest hearth, and if the increase of the firing rate of such burner to its maximum firing rate is insufficient to produce the desired control of the hottest hearth temperature, the oxygen content of the system exhaust gas or the system exhaust gas temperature, increasing the firing rate of at least one burner on the burner hearth most remote from the thus determined hottest hearth and on which at least one burner is firing, and if the decrease of such burner to its minimum firing rate or the turning off of said burner is insufficient to produce the desired control of the hottest hearth temperature, the oxygen content of the system exhaust gas or the system exhaust gas temperature, decreasing the firing rate of at least one burner on the burner hearths successively closer to the thus determined hottest hearth.

19. The method as claimed in claim 1 in which the steps of controlling the firing rate of the burners on the burner hearths comprises increasing the firing rate to a rate for bringing the temperature of the corresponding burner hearth to a maximum temperature sufficiently below the hottest hearth temperature for avoiding confusion as to which hearth is the hottest hearth.

20. In a method for controlling the operation of a multiple hearth furnace system in the excess air mode for efficiently incinerating combustible materials, said furnace having a plurality of superimposed hearths to which the combustible materials are introduced at the upper portion of the furnace and passed downward from hearth to hearth for being incinerated and the ash is discharged at the bottom of said furnace through an ash outlet, at least some of said hearths being burner hearths having burners for adding heat to such hearths, and said furnace system having means for introducing combustion air at the bottom thereof and the unreacted combustion air and the gaseous products of combustion flow upward countercurrent to the flow of combustible materials and are exhausted from the top of the furnace, the improvement which comprises:

scanning the temperatures of the combustible material handling hearths to determine which is the hottest hearth;

(a) controlling the temperature of the thus-determined hottest hearth at a predetermined temperature set point value by sensing the temperature of the hottest hearth and when it is sensed as rising above the set point value, controlling combustion air flow to the bottom of the furnace system to increase the air flow and when it is sensed as falling below the set point value, decreasing the air flow;

(b) maintaining the content of oxygen in the system exhaust gas at a predetermined set point by sensing the oxygen content and when it falls below said set point, increasing the firing rate of at least one burner located on the next burner hearth below the hottest hearth to raise the temperature of the burner hearth which will in turn cause the combustion air flow introduced at the bottom of the furnace to increase to prevent the temperature of the hottest hearth from substantially increasing above the set point temperature, said increased combustion air flow raising the oxygen content in the system exhaust gas, said firing rate being increased until the oxygen content in the exhaust gas reaches the set point thereof, and if this is not reached after the firing rate of said burner is raised to its maximum, then carrying out the same increase of the firing rate of at least one burner on each successively lower burner hearth below the hottest hearth until the oxygen set point is reached, and when the sensed oxygen content rises above the set point, decreasing the firing rate of at least one burner on the burner hearth below the hottest hearth which is the most remote burner hearth having a burner firing thereon to decrease the temperature of the burner hearth which will in turn cause the combustion air flow introduced at the bottom of the furnace to decrease to cause the temperature of the hottest hearth to increase above the set point temperature, said decreased combustion air flow reducing the oxygen content in the system exhaust gas, said firing rate being decreased until the oxygen content in the exhaust gas reaches the set point thereof, and if this is not reached after the firing rate of said burner is reduced to its miminum or the burner turned off, then carrying out the same decrease of the firing rate of at least one burner on each burner hearth below the hottest hearth which is successively closer to said hottest hearth;

(c) maintaining the system exhaust gas temperature at a predetermined set point value by, when the temperature of the system exhaust gas is sensed as falling below its set point value, increasing the firing rate of at least one burner located on the next burner hearth above the hottest hearth to raise the temperature of the exhaust gas to its set point temperature value, and if this is not achieved after the firing rate of said burner is raised to its maximum, then carrying out the same increase of the firing of at least one burner on each successively higher burner hearth above the hottest hearth until the set point value of the temperature is reached, and when the temperature of the system exhaust gas is sensed as rising above its set point value, decreasing the firing rate of at least one burner located on the burner hearth above the hottest hearth which is the most remote burner hearth having a burner firing thereon to decrease the temperature of the exhaust gas to its set point value, and if this is not achieved after the firing rate of said burner is reduced to its minimum or the burner turned off, then carrying out the same decrease of the firing rate of at least one burner on each burner hearth above the hottest hearth which is successively closer to the hottest hearth.

21. In a method for controlling the operation of a multiple hearth furnace system in the excess air mode for efficiently incinerating combustible materials, said furnace having a plurality of superimposed hearths to which the combustible materials are introduced at the upper portion of the furnace and passed downward from hearth to hearth for being incinerated and the ash is discharged at the bottom of said furnace through an ash outlet, at least some of said hearths being burner hearths having burners for adding heat to such hearths, and said furnace system having means for introducing combustion air at the bottom thereof and the unreacted combustion air and the gaseous products of combustion flow upward countercurrent to the flow of combustible materials and are exhausted from the top of the furnace, the improvement which comprises:

scanning the temperatures of the combustible material handling hearths to determine which is the hottest hearth;

(a) controlling the temperature of the thus determined hottest hearth at a predetermined temperature set point value by sensing the temperature of the hottest hearth and when it is sensed as falling below the set point value, increasing the firing rate of at least one burner located on the next burner hearth below the hottest hearth to raise the temperature of the burner hearth, said firing rate being increased until the temperature of the hottest hearth reaches the set point thereof, and if this is not reached after the firing rate of said burner is raised to its maximum, then carrying out the same increase of the firing rate of at least one burner on each successively lower burner hearth below the hottest hearth until the hottest hearth temperature point is reached, and when it is sensed as rising above said set point value, decreasing the firing rate of at least one burner on the burner hearth below the hottest hearth which is the most remote burner hearth having a burner firing thereon to decrease the temperature of the hottest hearth, said firing rate being decreased until the hottest hearth temperature reaches the set point thereof, and if this is not reached after the firing rate of said burner is reduced to its minimum or the burner turned off, then carrying out the same decrese of the firing rate of at least one burner on each burner hearth below the hottest hearth which is successively closer to said hottest hearth;

(b) maintaining the content of oxygen in the system exhaust gas at a predetermined set point by sensing the oxygen content and when it falls below said set point, increasing the combustion air flow introduced at the bottom of the furnace, said increased combustion air flow raising the oxygen content in the system exhaust gas, and when the sensed oxygen content rises above the set point, decreasing the combustion air flow introduced at the bottom of the furnace to decrease the oxygen content in the system exhaust gas;

(c) maintaining the system exhaust gas temperature at a predetermined set point value by, when the temperature of the system exhaust gas is sensed as falling below its set point value, increasing the firing rate of at least one burner located on the next burner hearth above the hottest hearth to raise the temperature of the exhaust gas to its set point temperature value, and if this is not achieved after the firing rate of said burner is raised to its maximum, then carrying out the same increase of the firing of at least one burner on each successively higher burner hearth above the hottest hearth until the set point value of the temperature is reached, and when the temperature of the system exhaust gas is sensed as rising above its set point value, decreasing the firing rate of at least one burner located on the burner hearth above the hottest hearth which is the most remote burner hearth having a burner firing thereon to decrease the temperature of the exhaust gas to its set point value, and if this is not achieved after the firing rate of said burner is reduced to its minimum or the burner turned off, then carrying out the same decrease of the firing rate of at least one burner on each burner hearth above the hottest hearth which is successively closer to the hottest hearth.

22. The improvement as claimed in claim 21 further comprising, if the reduction of the firing rate of the burner below the hottest hearth fails to reduce the temperature of the hottest hearth to the set point temperature, increasing the flow of combustion air to the bottom of the furnace system.

23. In a method for controlling the operation of a multiple hearth furnace system in the pyrolysis mode for efficiently incinerating combustible materials, said furnace having a plurality of superimposed hearths to which the combustible materials are introduced at the upper portion of the furnace and passed downward from hearth to hearth for being incinerated and the ash is discharged at the bottom of said furnace through an ash outlet, at least some of said hearths being burner hearths having burners for adding heat to such hearths, and said furnace system having means for introducing combustion air at the bottom thereof and the unreacted combustion air and the gaseous of combustion flow upwardly countercurrent to the flow of combustible materials and means for exhausting gases from the top of the furnace and including an afterburner, the improvement which comprises:

scanning the temperatures of the combustible material handling hearths to determine which is the hottest hearth;

(a) controlling the temperature of the thus-determined hottest hearth at a predetermined temperature set point value by sensing the temperature of the hottest hearth and when it is sensed as rising above the set point value, controlling combustion air flow to the bottom of the furnace system to decrease the air flow and when it is sensed as falling below the set point value, increasing the air flow;

(b) maintaining the content of oxygen in the system exhaust gas at a predetermined set point by sensing the oxygen content and when it falls below said set point, increasing the flow of afterburner air to the afterburner for raising the oxygen content in the system exhaust gas, said flow of afterburner air being increased until the oxygen content in the exhaust gas reaches the set point thereof, and when the sensed oxygen content content raises above the set point, decreasing the flow of afterburner air to the afterburner for reducing the oxygen content in the system exhaust gas;

(c) maintaining the system exhaust gas temperature at a predetermined set point value by, when the temperature of the system exhaust gas is sensed as falling below its set point value, increasing the firing rate of at least one burner located on the next burner hearth above the hottest hearth to raise the temperature of the exhaust gas to its set point temperature value, and if this is not achieved after the firing rate of said burner is raised to its maximum, then carrying out the same increase of the firing of at least one burner on each successively higher burner hearth above the hottest hearth until the set point value of the temperature is reached, and when the temperature of the system exhaust gas is sensed as rising above its set point value, decreasing the firing rate of at least one burner located on the burner hearth above the hottest hearth which is the most remote burner hearth having a burner firing thereon to decrease the temperature of the exhaust gas to its set point value, and if this is not achieved after the firing rate of said burner is reduced to its minimum or the burner turned off, then carrying out the same decrease of the firing rate of at least one burner on each burner hearth above the hottest hearth which is successively closer to the hottest hearth.

24. The improvement as claimed in claim 23 further comprising, if the reduction of the firing rate of the burners above the hottest hearth fails to reduce the system exhaust gas temperature to the system exhaust gas set point temperature, increasing the flow of afterburner air to the afterburner.

25. In a method for controlling the operation of a multiple hearth furnace system in the pyrolysis mode for efficiently incinerating combustible materials, said furnace having a plurality of superimposed hearths to which the combustible materials are introduced at the upper portion of the furnace and passed downward from hearth to hearth for being incinerated and the ash is discharged at the bottom of said furnace through an ash outlet, at least some of said hearths being burner hearths having burners for adding heat to such hearths, and said furnace system having means for introducing combustion air at the bottom thereof and the unreacted combustion air and the gaseous of combustion flow upwardly countercurrent to the flow of combustible materials and means for exhausting gases from the top of the furnace and including an afterburner, the improvement which comprises:

scanning the temperatures of the combustible material handling hearths to determine which is the hottest hearth;

(a) controlling the temperature of the thus determined hottest hearth at a predetermined temperature set point value by sensing its temperature of the hottest hearth and when it is sensed as rising above the set point temperature controlling combustion air flow to the bottom of the furnace system to decrease the air flow and when it is sensed as falling below the set point value, increasing the air flow;

(b) maintaining the content of oxygen in the system exhaust gas at a predetermined set point by sensing the oxygen content and when it falls below said set point, increasing the firing rate of at least one burner located on the next burner hearth above the hottest hearth to raise the temperature of the system exhaust gas which will in turn cause the air flow to the afterburner to increase for increasing the oxygen content in the system exhaust gas, said firing rate being increased until the oxygen content in the exhaust has reached the set point thereof, and if this is not reached after the firing rate of said burner is raised to its maximum, then carrying out the same increase of the firing rate of at least one burner on each successively higher burner hearth below the hottest hearth until the oxygen set point is reached, and when the sensed oxygen content rises above the set point, decreasing the firing rate of at least one burner on the burner hearth above the hottest hearth which is the most remote burner hearth having a burner firing thereon to decrease the temperature of the burner hearth which will in turn cause the afterburner air flow to decrease for reducing the oxygen content in the system exhaust gas, said firing rate being decreased until the oxygen content in the exhaust gas reaches the set point thereof, and if this is not reached after the firing rate of said burner is reduced to its minimum or the burner turned off, then carrying out the same decrease of the firing rate of at least one burner on each burner hearth above the hottest hearth which is successively closer to said hottest hearth;

(c) maintaining the system exhaust gas temperature at a predetermined set point value by, when the temperature of the system exhaust gas is sensed as falling below its set point value, decreasing the air flow rate to the afterburner to reduce the temperature of the exhaust gas to its set point temperature value, and when the temperature of the system exhaust gas is sensed as rising above its set point value, increasing the air flow rate to the afterburner to decrease the temperature of the exhaust gas to its set point value.

26. In combination, a multiple hearth furnace system for incinerating combustible materials and comprising a plurality of superimposed hearths to which solid combustible materials are introduced at the upper portion of said furnace system, means for passing the solid combustible materials downward from hearth to hearth for being incinerated, ash outlet means for discharging the ash from the bottom of said furnace system, at least one variable firing rate burner on at least some of said hearths, fuel and air supply means connected to said burners for supplying fuel and fuel combustion air to said burners, combustion air introducing means for introducing combustion air into the bottom of said furnace system, and exhaust means for exhausting system exhaust gas from the top of said furnace system, and a control means for controlling the operation of said multiple hearth furnace system and comprising scanning means connected to each of the combustible material handling hearths for scanning the temperatures of each of the hearths and determining which of the hearths is the hottest hearth and whether the temperature of the thus-determined hottest hearth is at above or below a predetermined temperature, combustion air flow control means connected to said combustion air introducing means for controlling the flow of combustion air, burner controller means connected to the corresponding burners for controlling the firing rates of the respective burners, oxygen analyzing means in said exhaust means for sensing the oxygen content in the system exhaust gases and determining whether it is at, above or below a predetermined value, and temperature sensing means in said exhaust means for sensing the temperature of the system exhaust gas and determining whether it is at, above or below a predetermined value.

27. The combination as claimed in claim 26 further comprising afterburner air supply means connected to said exhaust means and afterburner air flow control means connected to said afterburner air supply means.

28. The combination as claimed in claim 26 in which:

said scanning means comprises temperature sensors in each of said hearths, scanner to which said temperature sensors are connected for scanning the temperatures of the hearths and for choosing from among the scanned temperatures the highest temperature, and producing an indication of which of the hearths is the hottest hearth and the temperature of said hottest hearth, and a hottest hearth temperature controller settable to a predetermined value and connected to said scanner for receiving the temperature of the hottest hearth and comparing it with said predetermined value and providing an indication of whether it is at, above or below said predetermined value, and a hottest hearth temperature set point controller connected to said hottest hearth temperature controller for changing the set point of the temperature thereof;

said burner controller means comprises burner controllers connected to each burner and capable of being set to a temperature set point and for controlling the firing rate of the corresponding burner to cause the burner to burn at a rate for bringing the temperature of the corresponding burner hearth to the set temperature, and a burner temperature set point controller connected to each of said burner controllers for changing the temperature set point thereof;

said oxygen analyzing means comprises an oxygen analyzer for analyzing the system exhaust gas for determining the oxygen content thereof and an oxygen controller settable to a predetermined set point value and for receiving the oxygen content of the system exhaust gas and comparing it with the set point value and providing an indication of whether it is at, above or below the set point value, and an oxygen set point controller connected to said oxygen controller for changing the set point value thereof; and said system exhaust gas temperature sensing means comprises settable to a predetermined set point value a temperature sensor, a system exhaust gas temperature controller and connected to said exhaust gas temperature sensor for receiving the system exhaust gas temperature therefrom and comparing it with the set point value and providing an indication of whether it is at, above or below the set point value, and a system exhaust gas temperature set point controller connected to said system exhaust gas temperature controller for changing the set point value thereof.

* * * * *